US005967097A

United States Patent [19]

Kastner et al.

[11] Patent Number: 5,967,097

[45] Date of Patent: Oct. 19, 1999

[54] ONCE-THROUGH STEAM GENERATOR AND A METHOD OF CONFIGURING A ONCE-THROUGH STEAM GENERATOR

[75] Inventors: Wolfgang Kastner, Herzogenaurach; Wolfgang Köhler, Kalchreuth; Eberhard Wittchow, Erlangen, all of Germany

[73] Assignee: Siemens Aktiengesellschaft, Munich, Germany

[21] Appl. No.: 09/123,102

[22] Filed: Jul. 27, 1998

Related U.S. Application Data

[63] Continuation of application No. PCT/DE97/00049, Jan. 14, 1997.

[30] Foreign Application Priority Data

Jan. 25, 1996 [DE] Germany ..... 196 02 680

[51] Int. Cl.[6] ..... F22B 37/12

[52] U.S. Cl. ..... 122/1 B; 122/6 A; 122/406.4

[58] Field of Search ..... 122/1 B, 6 A, 122/235.12, 367.3, 406.4, 451

[56] References Cited

U.S. PATENT DOCUMENTS

| | | | |
|---|---|---|---|
| 4,987,862 | 1/1991 | Wittchow et al. | 122/406.4 |
| 5,662,070 | 9/1997 | Kastner et al. | 122/6 A |
| 5,706,766 | 1/1998 | Koehler et al. | 122/6 A |

FOREIGN PATENT DOCUMENTS 2 032 891 2/1971 Germany .

43 33 404 A1 4/1995 Germany .

OTHER PUBLICATIONS

"Evaporator concepts for Benson–steam generators" (Franke et al.), VGB power plant engineering, vol. 73, No. 4, 1993, pp.352–361.

"New types of boilers manufactured by Mitsubishi for supercritical–and ultra–supercritical–pressure power–generating units" (Semenovker), Thermal Engineering, vol. 41, No. 8, 1994, pp. 655–661.

*Primary Examiner*—Teresa Walberg
*Assistant Examiner*—Gregory A. Wilson
*Attorney, Agent, or Firm*—Herbert L. Lerner; Laurence A. Greenberg

[57] ABSTRACT

The combustion chamber of a once-through steam generator is formed with walls of vertical tubes through which a flow medium flows from the bottom upwards. The tubes have a surface structure on their inner wall surfaces. Particularly favorable mass flow density $\dot{m}$ is established in the tubes at the load at which critical pressure prevails in the tubes according to the formula:

$$\dot{m} = \frac{q_i}{C(T_{\max} - T_{crit} - \Delta T_W)} \quad (\mathrm{kg/m^2s})$$

wherein $q_i$ is a heat flow density on an inner tube wall surface, $T_{max}$ is a maximum permissible material temperature of the tubes, $T_{crit}$ is a temperature of the flow medium at the critical pressure, $\Delta T_W$ is a temperature difference between the outer and inner wall surfaces of the tubes, and C is a constant.

16 Claims, 4 Drawing Sheets

ONCE-THROUGH STEAM GENERATOR AND A METHOD OF CONFIGURING A ONCE-THROUGH STEAM GENERATOR

CROSS-REFERENCE TO RELATED APPLICATION

This is a continuation of copending international application PCT/DE97/00049, filed on Jan. 14, 1997, which designated the United States.

BACKGROUND OF THE INVENTION

FIELD OF THE INVENTION

The invention relates to a once-through steam generator with a combustion chamber surrounded by a containment wall composed of tubes connected to one another in a gastight manner, a flow medium being capable of flowing from the bottom upward through the vertically extending tubes which have a surface structure on their inside. It relates, further, to a method for configuring a once-through steam generator of this type.

A steam generator of this type is known from the paper "Verdampferkonzepte für Benson-Dampferzeuger" [Evaporator Concepts for Benson Steam Generators] by J. Franke, W. Kohler and E. Wittchow, published in VGB Kraftwerkstechnik 73 (1993), No. 4, pages 352–360. In a once-through steam generator of this type, in contrast to a natural circulation or forced circulation steam generator with only partial evaporation of the water/steam mixture, the heating of evaporator tubes forming the combustion chamber leads to the complete evaporation of the flow medium in the evaporator tubes in a single pass. Whereas, in the natural circulation steam generator, the evaporator tubes extend substantially, the evaporator tubes of the once-through steam generator may be both vertically and spirally, hence at an incline.

A once-through steam generator, the combustion chamber walls of which are composed of vertically arranged evaporator tubes, can be produced more cost-effectively than a once-through steam generator having spiral tubing. Furthermore, once-through steam generators with vertical tubing have lower water-side/steam-side pressure losses than those with evaporator tubes which are inclined or that ascend spirally. Furthermore, in contrast to a natural circulation steam generator, a once-through steam generator is not subject to any pressure limitation, so that fresh steam pressures well above the critical pressure of water ($p_{crit}$=221 bar), where there is only a slight density difference between the liquid-like and steam-like medium. High fresh-steam pressures are necessary in order to achieve high thermal efficiencies and consequently low $CO_2$ emissions.

A particular problem, in this case, is the structural design of the combustion-chamber or containing wall of the once-through steam generator with regard to the operating temperatures of the tube-wall or the materials. In the subcritical pressure range up to about 200 bar, the temperature of the combustion-chamber wall is determined essentially by the value of the water saturation temperature, when wetting of the heating surface in the evaporation zone can be ensured. This is achieved, for example, by the use of internally ribbed tubes. Tubes of this type and their use in steam generators are known, for example, from European patent application 0 503 116. These so-called ribbed tubes, i.e., tubes with a ribbed inner wall surface, have particularly good heat transfer from the inner wall to the flow medium.

In the pressure range of about 200 to 221 bar, the heat transfer from the inner wall of the tube to the flow medium decreases sharply, so that the flow velocity—the mass flow density is usually used as a measure of this—has to be increased correspondingly, in order to ensure that the tubes are cooled sufficiently. Consequently, in the evaporator tubes of once-through steam generators operated at pressures of approximately 200 bar and above, the mass flow density and therefore the pressure loss due to friction must be higher than in once-through steam generators operated at pressures of below 200 bar. Particularly in the case of small inner diameters of the tubes, the higher pressure loss due to friction cancels out the advantageous property of vertical tubing but, when there is multiple heating of individual tubes, their through put also rises. However, since high steam pressures of more than 200 bar are required in order to achieve high thermal efficiencies and therefore low $CO_2$ emissions, it is necessary, in this pressure range too, to ensure good heat transfer. Consequently, once-through steam generators with a vertically tubed combustion-chamber wall are conventionally operated with relatively high mass flow densities in the tubes, so as to ensure, in the unfavorable pressure range of about 200 to 221 bar, that there is always a sufficiently degree of heat transfer from the tube wall to the flow medium, that is to say to the water/steam mixture. In this context, the publication "Thermal Engineering" I. E. Semenovker, Vol. 41, No. 8, 1994, pp. 655–661, specifies a mass flow density at 100% load of about 2000 kg/m$^2$s consistently both for gas-fired and for coal-fired steam generators.

SUMMARY OF THE INVENTION

It is accordingly an object of the invention to provide a once-through steam generator and a method of configuring a once-through steam generator, which overcomes the above-mentioned disadvantages of the prior art devices and methods steam-generator containing wall, a design criterion that is suitable in terms of a particularly favorable mass flow density in the tubes.

With the foregoing and other objects in view there is provided, in accordance with the invention, a once-through steam generator, comprising:

a containing wall enclosing a combustion chamber, the containing wall being formed from a multiplicity of substantially vertical tubes connected to one another in a gas-tight manner;

the tubes being adapted to conduct therein a flow medium from a bottom upwards, and the tubes being formed with a surface structure on an inner wall thereof; and wherein a mass flow density $\dot{m}$ in the tubes, at a load at which a critical pressure prevails in the tubes, is defined by the following relationship:

$$\dot{m} = \frac{q_i}{C(T_{\max} - T_{crit} - \Delta T_W)} \quad (\mathrm{kg/m^2s})$$

where $q_i$ (kW/m$^2$) is a heat flow density on an inside of the tubes, $T_{max}$ (° C.) is a maximum permissible material temperature of the tubes, $T_{crit}$ (° C.) is a temperature of the flow medium at the critical pressure ($p_{crit}$), $\Delta T_W$ (K) is a temperature difference between an outer wall and the inner wall of the tubes, and $C \geqq 7.3 \cdot 10^{-3}$ kWs/kgK is a constant.

The invention proceeds from the consideration that, in the flow-related design of the internally ribbed tubes, two basically contradictory conditions must be satisfied with regard to the mass flow density. On the one hand, the mean mass flow density in the tubes must be chosen to be as low as possible. This ensures that a greater mass flow traverses those tubes which receive more heat due to unavoidable heating differences, than those tubes which have average heating. This natural-circulation characteristic known from the drum-type boiler leads, at the outlet of the evaporator heating surface, to an equalization of the steam temperature and consequently of the tube-wall temperatures.

On the other hand, the mass flow density in the tubes must be chosen to be high enough that reliable cooling of the tube wall is ensured and permissible material temperatures are not exceeded. Extreme local overheating of the tube material and the consequential damage (tube cracks) are thereby avoided. Essential variables that influence the material temperature are, in addition to the temperature of the flow medium, the external heating of the tube wall and the heat transfer from the inner tube wall to the flow medium (fluid). There is therefore a connection between the internal heat transfer, which is influenced by the mass flow density, and the external heating of the tube wall.

The invention, then, proceeds from the finding that the connection between the internal minimum heat transfer coefficient $\alpha_{min}$ and the mass flow density $\dot{m}$ can be described in permissibly simplified form by the relationship:

$$\alpha_{min}=C\sim\dot{m} \tag{1}$$

wherein: $\alpha_{min}$ (kW/m$^2$K) is the heat transfer coefficient, $\dot{m}$ (kg/m$^2$s) is the mass flow density in the ribbed tubes, and C is a constant with the mean value of $C=7.3\cdot10^{-3}$ kWs/kgK for commercially available tubes.

Depending on the structure of the inner surface of the tubes (i.e. the rifling), the constant C can also be chosen to lie in the range between $7.3\cdot10^{-3}$ kWs/kgK and $12\cdot10^{-3}$ kWs/kgK.

The relationship (1) gives an optimum mass flow density in the tubes which both result in a favorable throughflow characteristic (natural-circulation characteristic) and also ensures reliable cooling of the tube wall and consequently adherence to the permissible material temperatures.

A fundamental consideration in deriving the relationship for the mass flow density in the tubes is that, at a given external heating of the tube wall—in the following referred to as the heat flow density (kW/m$^2$), i.e. the heat transfer per unit area—the material temperature of the tube wall is only slightly, but definitely, below the permissible value. In this case, it is necessary to bear in mind the physical phenomenon that the heat transfer from the inner tube wall to the flow medium is most unfavorable in the critical pressure range of about 200 to 221 bar.

Comprehensive tests show that the highest material stress is obtained when a relatively low mass flow density is combined with the highest heat flow density in the evaporation zone at about 200 to 221 bar. This is the case, for example, in the burner region of the combustion chamber. If evaporation is subsequently terminated and steam superheating commences, the material stress on the tubes of a combustion-chamber wall decreases. This is due to the fact that, in a conventional burner configuration and a conventional combustion cycle, the heat flow density also decreases.

It has been found, furthermore, that, in other pressure ranges too, no heat transfer problems arise in the context of ribbed tubes, if sufficient cooling of the tube walls is ensured in the pressure range of 200 to 221 bar. Thus, at low pressures below approximately 200 bar, the internal ribbing of the tubes causes critical boiling to commence only at the end of the evaporation zone, i.e. in a region with a reduced heat flow density. Critical boiling no longer occurs in the supercritical pressure range. Heat transfer, then, is so intensive that sufficient cooling of the tube wall is ensured.

The optimum mass flow density $\dot{m}$ in the tubes of the tube wall thus is a compromise between an advantageous throughflow characteristic on the one hand and reliable cooling of the tube wall on the other hand. The following procedure may be used to configure the system to the optimum mass flow density $\dot{m}$ in the tubes:

Step 1:

Determination of the heat flow density $q_a$ on the outside of the tube, based on the thermal calculation of the load at which a pressure of 210 bar prevails in the tubes of the tube wall. This heat flow density determined in this way must be increased by a factor of between 1.1 and 1.5, in order to allow for local irregularities in heat transfer.

Step 2:

Calculation of the maximum permissible material temperature $T_{max}$ at the tube apex on the heated side of the tube wall. Assuming a mean temperature of the combustion chamber wall that corresponds to the mean value of $T_{max}$ and $T_{crit}$, the maximum thermal stress is calculated as:

$$\sigma_{\max} = \frac{T_{\max} - T_{crit}}{2}\beta\cdot E \quad (\mathrm{N/mm^2}) \tag{2}$$

where $\sigma_{max}$ maximum thermal stress (N/mm$^2$)

$T_{max}$ maximum material temperature (° C.)

$T_{crit}$ temperature of the fluid at critical point (° C.)

$\beta$ coefficient of thermal expansion (1/K)

E modulus of elasticity (N/mm$^2$)

Since the stresses which are crucial here are thermal stresses, these can be guarded against as secondary stresses according to the ASME Code with triple the value of the permissible stresses $\sigma_{perm}$. This results in the temperature $T_{max}$ as $$T_{\max} = T_{crit} + \frac{6\cdot\sigma_{perm}}{\beta\cdot E} \quad (°\mathrm{C.}) \tag{3}$$

The permissible stress may be taken from the particular specification sheet supplied by the respective tube manufacturer.

Step 3:

Conversion of the predetermined heat flow density $q_a$ (related to the outside of the tube wall) to a heat flow density $q_i$ which is related to the inner wall of the tubes:

$$q_i = \frac{K\cdot d_a}{d_i}\cdot q_a \quad (\mathrm{kW/m^2}) \tag{4}$$

The determination of the heat redistribution factor K is based on temperature field calculations and can be arrived at with sufficient accuracy as follows:

$$K=A(d_a^2\cdot q_a)+B \tag{5}$$

for:

A=0.45, B=0.625 for $(d_a^2\cdot q_a)\leqq 0.5$ kW

A=0.25, B=0.725 for $(d_a^2\cdot q_a)>0.5$ and $\leqq 1.1$ kW

A=0 and B=1 for $(d_a^2\cdot q_a)>1.1$ kW;

where:

$d_a$=outer tube diameter (m)

$d_i$=inner tube diameter (m)

$q_a$=heat flow density on the outside (kW/m $^2$)

$q_1$=heat flow density on the inside (kW/m$^2$).

Step 4:

Determination of the temperature difference $\Delta T_W$ between the outer tube wall and the inner tube wall. The temperature difference $\Delta T_W$ is determined by means of the heat conduction equation:

$$\Delta T_w = \left(\frac{1+K}{2}\right)\frac{q_a \cdot d_a}{2\lambda} \cdot \ln\frac{d_a}{d_i} \quad \text{(K)} \tag{6}$$

where $\lambda$=thermal conductivity of the tube material (kW/mK).

Step 5:

Determination of the necessary mass flow density $\dot{m}$ according to the relationship:

$$\dot{m} = \frac{q_i}{C(T_{\max} - T_{crit} - \Delta T_W)} \quad \text{(kg/m}^2\text{s)} \tag{7}$$

Other features which are considered as characteristic for the invention are set forth in the appended claims.

Although the invention is illustrated and described herein as embodied in once-through steam generator and a method of configuring such as steam generator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
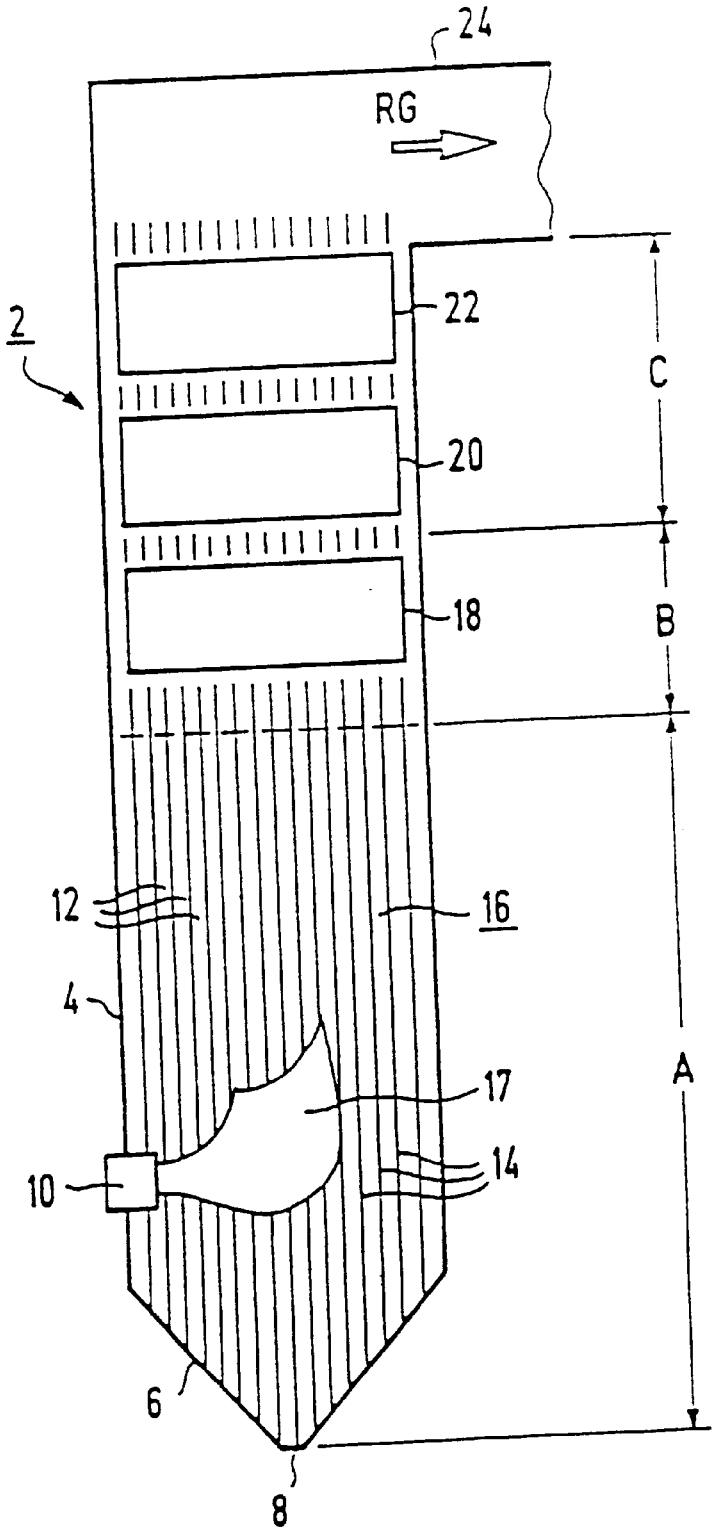
FIG. 1 is a schematic side view of a once-through steam generator with vertical evaporator tubes.

Referring now to the figures of the drawing in detail, wherein corresponding parts are provided with the same reference symbols throughout, and first, particularly, to FIG. 1 thereof, there is seen a diagrammatic once-through steam generator 2 of rectangular cross-section. A vertical gas flue of the steam generator is formed by a containing wall 4 which merges at the lower end into a funnel-shaped bottom 6. The bottom 6 comprises a discharge orifice 8 for ash.

A number of burners 10 for fossil fuel—only one burner is illustrated for clarity—are mounted, in a lower region A of the gas flue, in the containing wall or combustion chamber 4 formed from vertical evaporator tubes 12. The vertical evaporator tubes 12 are welded to one another in the region A, via tube fins or tube webs 14 and they form gas-tight combustion-chamber or containing walls. The evaporator tubes 12, through which the flow passes from the bottom upwards when the once-through steam generator 2 is in operation, form an evaporator heating surface 16 in the region A.

When the once-through steam generator 2 is in operation, a flame body 17 from the combustion of a fossil fuel is located in the combustion chamber 4. The region A of the once-through steam generator 2 is thereby distinguished by a very high heat flow density. The flame body 17 has a temperature profile which, starting from about the middle of the combustion chamber 4, decreases both upwards and downwards in the vertical direction and in the horizontal direction towards the sides, i.e., towards the corners of the combustion chamber 4. A second, flame-distant region B is located above the lower region A of the gas flue, above which a third upper region C of the gas flue is defined. Convection heating surfaces 18, 20 and 22 are disposed in the regions B and C of the gas flue. Located above the region C of the gas flue is a flue-gas outlet duct 24, via which the flue gas RG generated as a result of the combustion of the fossil fuel leaves the vertical gas flue.

Figure 2:
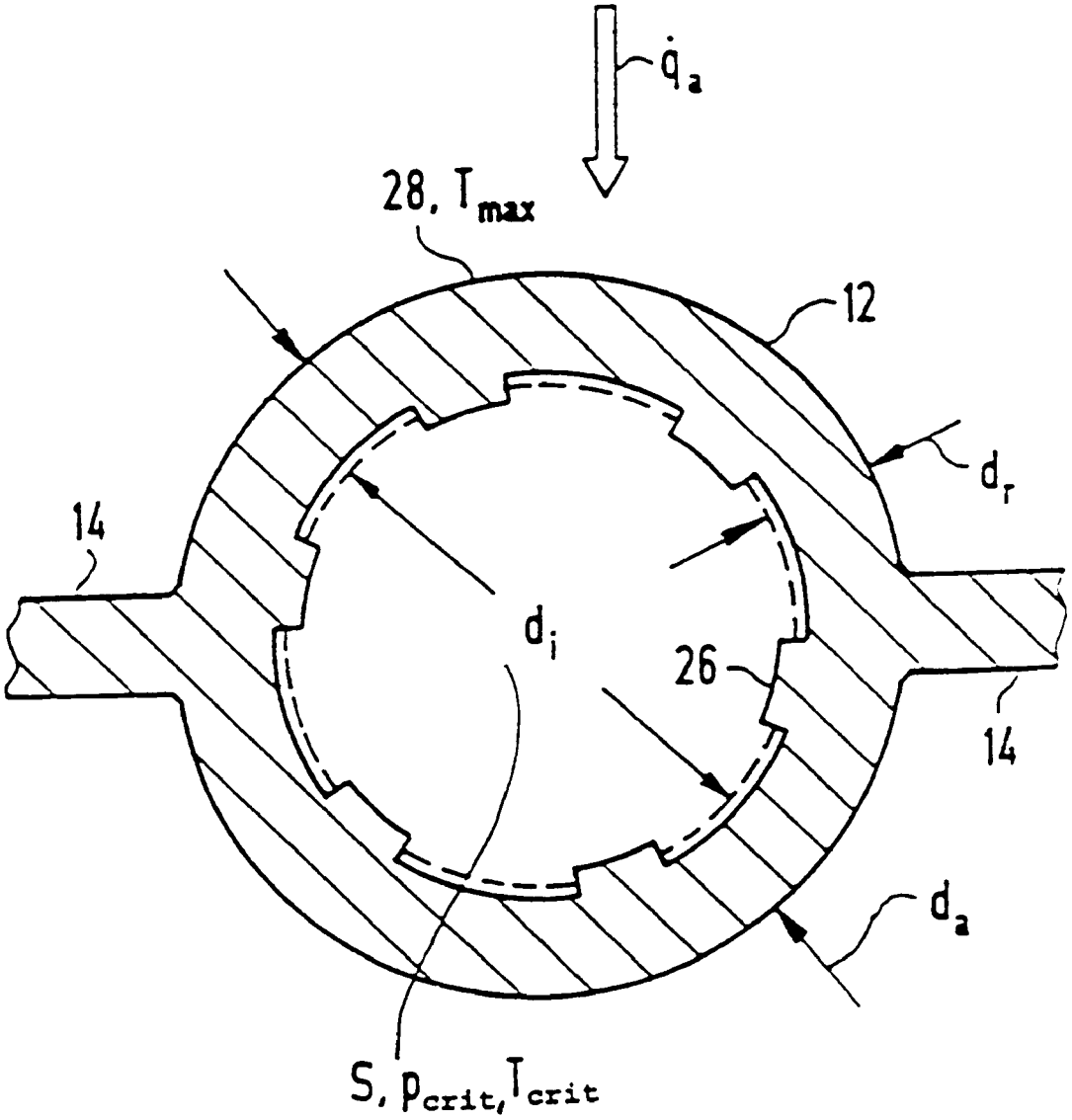
FIG. 2 is a cross-sectional view of an individual evaporator tube.

The section of FIG. 2 is through an evaporator tube 12 which is provided with ribs 26 on the inside and which, while the once-through steam generator 2 is in operation, is exposed on the outside, within the combustion chamber 4, to heating at a heat flow density $q_a$. A flow medium S flows internally of the tube 12. Mutually adjacent tubes 12 are interconnected by webs 14. The tubes 12 and the webs 14 define the walls of the flue wall 4. At the critical point, that is to say at the critical pressure $p_{crit}$ of 221 bar, the temperature of the flow medium or fluid in the tube 12 is designated by $T_{crit}$. The maximum permissible material temperature $T_{max}$ at the tube apex 28 on the heated side of the tube wall is used for calculating the maximum thermal stress $\sigma_{max}$. The inner diameter and outer diameter of the evaporator tube 12 are designated by $d_i$ and $d_a$ respectively. In the case of internally ribbed tubes, it is necessary to use the equivalent inner diameter which allows for the influence of the rib heights and rib valleys. The tube-wall thickness is designated by $d_r$.

Figure 3:
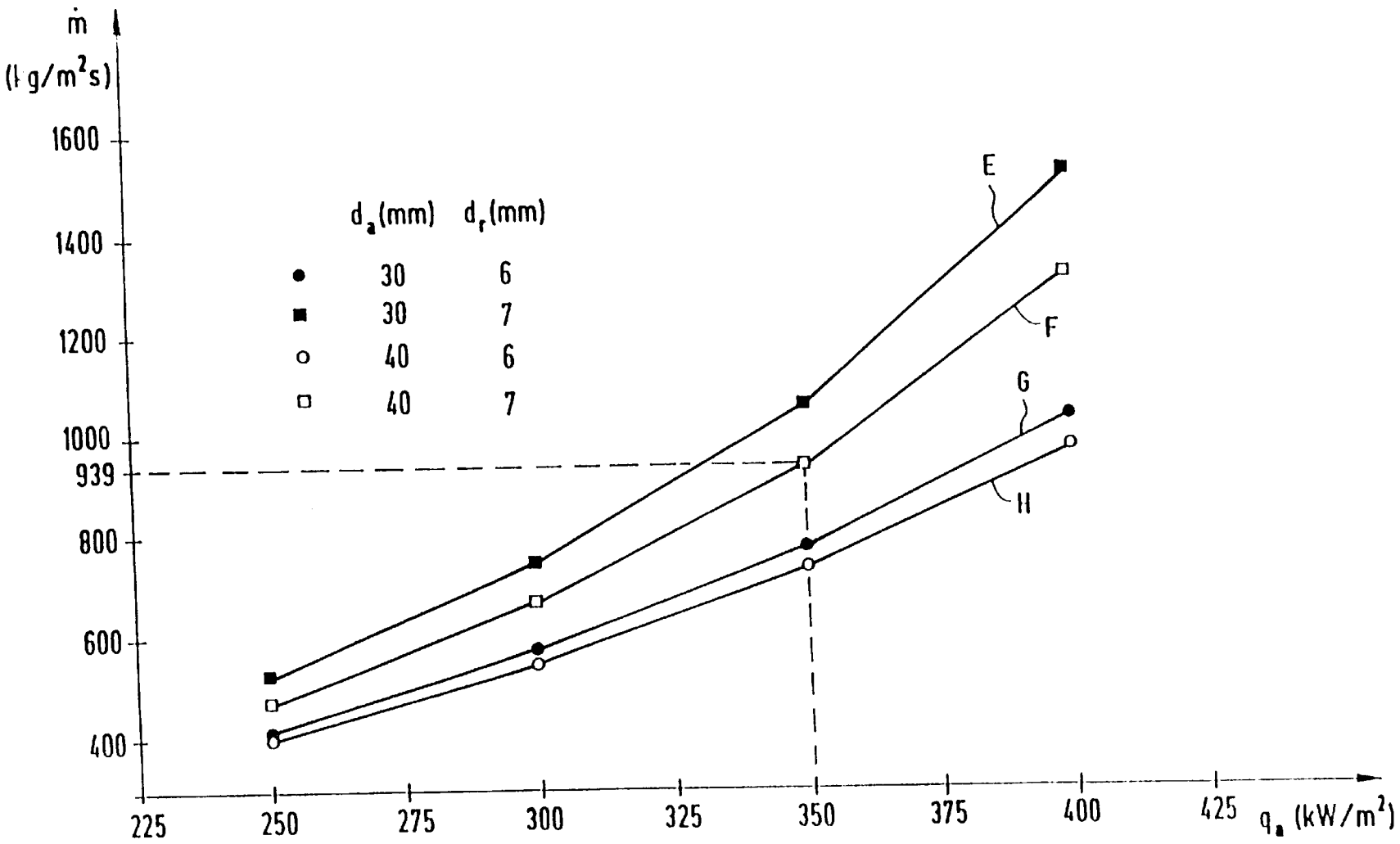
FIG. 3 is a graph with four curves (E, F, G, H) for the mass flow density in different geometries of an evaporator tube consisting of the material 13 CrMo 44.

Referring now to FIG. 3, there is shown a Cartesian coordinate system with four curves E, F, G and H. They represent different outer diameters $d_a$ (mm) and tube-wall thicknesses $d_r$ (mm). The heat flow density $q_a$ (kW/m$^2$) on the tube outside is plotted on the abscissa and the preferred or optimum mass flow density $\dot{m}$ (kg/m$^2$) is plotted on the ordinate. The curve E shows the trend for an outer tube diameter $d_a$ of 30 mm and a tube-wall thickness $d_r$ of 7 mm. The curve F represents the trend for a outer tube diameter $d_a$ of 40 mm and a tube-wall thickness $d_r$ of 7 mm. The curve G shows the trend of the mass flow density $\dot{m}$ in dependence on the heat flow density $q_a$, for a tube 12 having an outer diameter da of 30 mm and a tube-wall thickness $d_r$ of 6 mm. The curve H shows the trend of a tube 12 with an outer diameter $d_a$ of 40 mm and a tube-wall thickness $d_r$ of 6 mm. The mass flow densities $\dot{m}$ are calculated for heat flow densities $q_a$ of 250, 300, 350 and 400 kW/m$^2$ at the critical pressure $p_{crit}$ of the flow medium S for the tube material 13 CrMo 44.

An example of the determination of the optimum mass flow density $\dot{m}$ is shown below. In this case, the following conditions are presupposed:

$q_a$=250 kW/m$^2$; heat flow density on the tube outside at a pressure of 210 bar;

1.4 as raising factor allowing for local irregularities in the heat transfer to the tubes 12;

$d_a$=40 mm outer tube diameter, $d_r$=7 mm tube-wall thickness; and tube material: 13 CrMo 44.

Since $2d_r=d_a-d_i$, it follows from the above numerical values of $d_a$ and $d_r$ that: $d_i$=26 mm inner tube diameter.

Step 1: Calculating the heat flow density

The heat flow density based on thermal calculation is multiplied by the raising factor. This results in:

$$q_a=350\ \mathrm{kW/m^2}$$

Step 2: Determining maximum permissible material temperature

From equation (3), the temperature is calculated with $T_{crit}$=374° C. (temperature of the fluid at critical pressure $p_{crit}$), with $\beta=16.3\cdot10^{-6}$ (1/K) (coefficient of thermal expansion of 13 CrMo 44), $E=178\cdot10^3$ (N/mm$^2$) (modulus of elasticity of 13 CrMo 44), and $\sigma_{perm}$=68.5 (N/mm$^2$) (permissible stress of 13 CrMo 44 at the maximum permissible material temperature). Accordingly:

$$T_{max}=515°\ \mathrm{C.}$$

Figure 4:
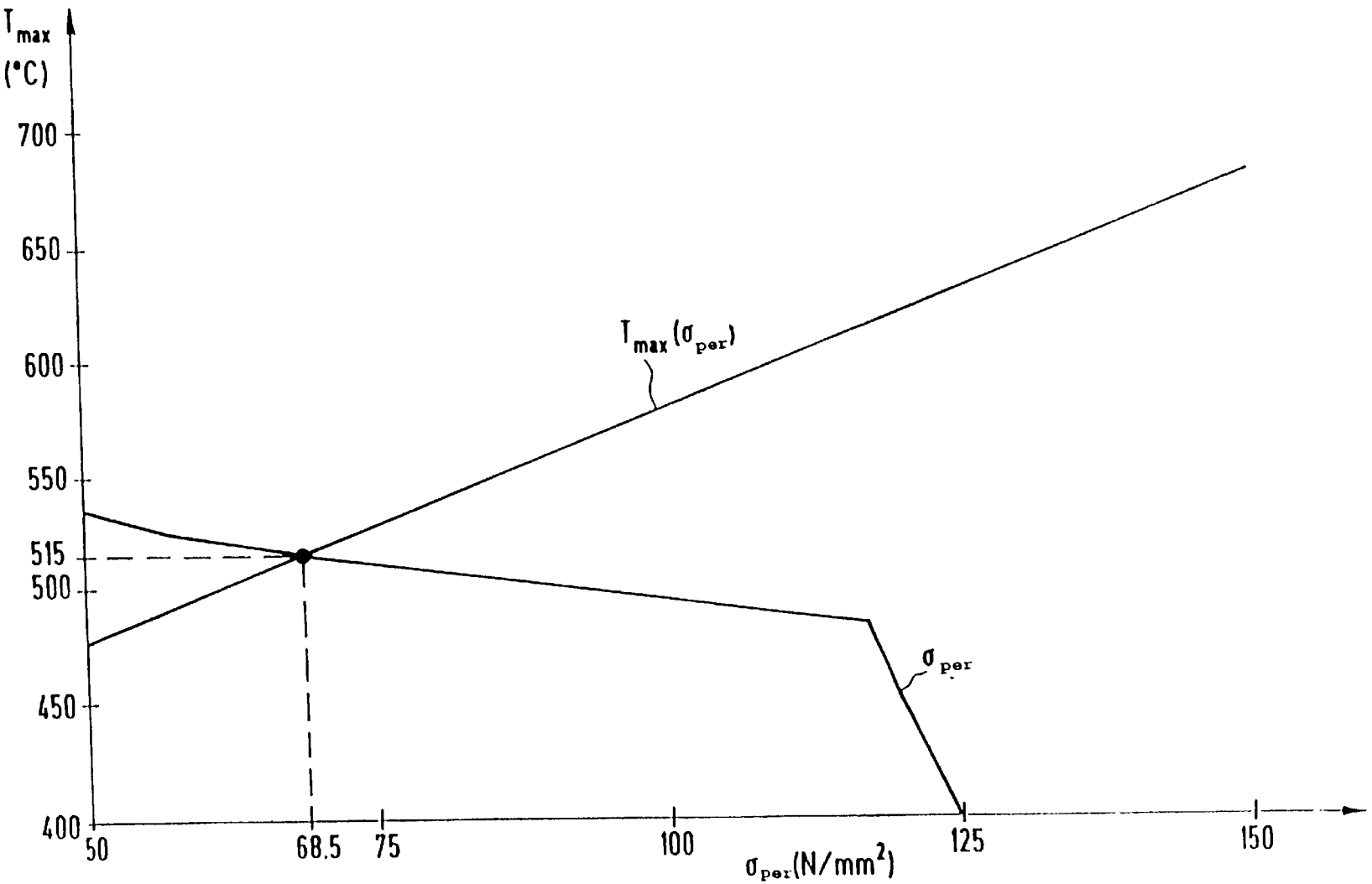
FIG. 4 is a graph showing the dependence of the maximum permissible material temperature of 13 CrMo 44 on the permissible stress (N/mm$^2$).

The determination of $T_{max}$, to be carried out iteratively, shows the dependence of the permissible stress $\sigma_{perm}$ on the material temperature. This dependence between the permissible stress $\sigma_{per}$ and the maximum material temperature $T_{max}$ for the material 13 CrMo 44 is graphically represented in FIG. 4.

Step 3: Heat flow density on the tube inside

From the equations (4) and (5), there follows for A=0.25 and B=0.725 for the heat flow density $q_i$ on the inside of the tubes 12:

$$q_i=466\ \mathrm{kW/m^2}$$

Step 4: Determining the temperature difference $\Delta T_W$ between the tube outer wall and tube inner wall From equation (6), with the thermal conductivity of 13 CrMo 44 of $\lambda=38.5\cdot10^{-3}$ kW/mK:

$$\Delta T_W=73\ \mathrm{K}$$

Step 5: Determining the necessary mass flow density

From equation (7), with $C=\mathbf{7.3\cdot10^{-3}}$ kWs/kgK:

$$\dot{m}=939\ \mathrm{kg/m^2s}$$

The optimum mass flow density $\dot{m}$ can thus be determined by means of the available values for the heat flow density $q_a$ on the tube outside and the maximum permissible material temperature $T_{max}$. This value is represented by dashed lines in FIG. 3 for the specified conditions. It can be seen that, for the assumed heat flow density $q_a$ on the outside of the tube of 350 kW/m$^2$, optimum mass flow densities $\dot{m}$ of between 740 and 1060 kg/m$^2$s are obtained for tubes 12 having outer diameters $d_a$ of between 30 and 40 mm and wall thicknesses $d_r$ of between 6 and 7 mm.

For the flow-related design of the tubes 12 of the tube wall or containing wall 4, the mass flow density $\dot{m}$ thus determined can still be converted to the conditions prevailing under 100% load. For this purpose, the operating pressure at the inlet of the tubes 12 is calculated at 100%. The above-mentioned mass flow densities $\dot{m}$ are subsequently converted in proportion to the operating pressure under 100% load. If, for example, the operating pressure under 100% load is $p_B$=270 bar, the mass flow density $\dot{m}$ increases from 740 to 951 kg/m$^2$ or from 1060 to 1363 kg/m$^2$s.

It may be expedient to allow for uncertainties in the determination of the heat flow density q, by raising the mass flow density $\dot{m}$ from +15% to +20% in relation to the calculated value.

We claim:

1. A once-through steam generator, comprising:

a containing wall enclosing a combustion chamber, said containing wall being formed from a multiplicity of substantially vertical tubes connected to one another in a gas-tight manner;

said tubes being adapted to conduct therein a flow medium from a bottom upwards, and said tubes being formed with a surface structure on an inner wall thereof; and wherein a mass flow density $\dot{m}$ in said tubes, at a load at which a critical pressure prevails in said tubes, is defined by the following relationship:

$$\dot{m}=\frac{q_i}{C(T_{\max}-T_{crit}-\Delta T_W)}\qquad(\mathrm{kg/m^2s})$$

where $q_i$ (kW/m$^2$) is a heat flow density on an inside of said tubes, $T_{max}$ (° C.) is a maximum permissible material temperature of said tubes, $T_{crit}$ (° C.) is a temperature of the flow medium at the critical pressure ($p_{crit}$), $\Delta T_W$ (K) is a temperature difference between an outer wall and the inner wall of said tubes, and $C\geqq7.3\cdot10^{-3}$ kWs/kgK is a constant.

2. The once-through steam generator according to claim 1, wherein the heat flow density $q_i$ at the inner wall conforms to the relationship:

$$q_i=\frac{K\cdot d_a}{d_i}\cdot q_a\qquad(\mathrm{kW/m^2})$$

with $k=A\cdot(d_a^2\cdot q_a)+B$, and wherein:

A=0.45, B=0.625 for $(d_a^2\cdot q_a)\geqq0.5$ kW

A=0.25, B=0.725 for $(d_a^2\cdot q_a)>0.5$ and $\leqq1.1$ kW

A=0 and B=1 for $(d_a^2\cdot q_a)>1.1$ kW;

$q_a$ (kW/m$^2$) being a heat flow density at an outer surface of said tubes and $d_a$ (m) being the outer tube diameter.

3. The once-through steam generator according to claim 1, wherein the maximum admissible material temperature $T_{max}$ conforms to the relationship:

$$T_{\max}=T_{crit}+\frac{6\cdot\sigma_{perm}}{\beta\cdot E}\qquad(°\mathrm{C.})$$

in which $\sigma_{perm}$ is a permissible thermal stress (N/mm$^2$), $\beta$ is a coefficient of thermal expansion (1/K), and E is a modulus of elasticity (N/mm$^2$) of a tube material.

4. The once-through steam generator according to claim 1, wherein the temperature difference $\Delta T_W$ between an outer tube wall and an inner tube wall conform to the relationship:

$$\Delta T_w = \left(\frac{1+K}{2}\right)\frac{q_a \cdot d_a}{2\lambda} \cdot \ln\frac{d_a}{d_i} \quad \text{(K)}$$

with $k=A\cdot(d_a^2\cdot q_a)+B$, and
wherein:

$A=0.45$, $B=0.625$ for $(d_a^2\cdot q_a)\leqq 0.5$ kW $A=0.25$, $B=0.725$ for $(d_a^2\cdot q_a)>0.5$ and $\leqq 1.1$ kW $A=0$ and $B=1$ for $(d_a^2\cdot q_a)>1.1$ kW;

$q_a$ (kW/m$^2$) being a heat flow density on an outer wall surface of said tubes, $d_a$ (m) being the outer tube diameter, $d_i$ (m) being the inner tube diameter, and $\lambda$ (kW/mK) being the thermal conductivity of the tube material.

5. The once-through steam generator according to claim 1, wherein said tubes consist of 13 CrMo 44 (T12 of ASTM A213), an outer tube diameter is 30 mm, a tube wall thickness is 7 mm, and wherein value pairs of the heat flow density $q_a$ and the mass flow density $\dot{m}$ lie along a curve in a Cartesian coordinate system defined by the following value pairs:

$q_a$=250 kW/m$^2$, $\dot{m}$=526 kg/m$^2$s, $q_a$=300 kW/m$^2$, $\dot{m}$=750 kg/m$^2$s, $q_a$=350 kW/m$^2$, $\dot{m}$=1063 kg/m$^2$s, and $q_a$=400 kW/m$^2$, $\dot{m}$=1526 kg/m$^2$s.

6. The once-through steam generator according to claim 1, wherein said tubes consist of 13 CrMo 44 (T12 of ASTM A213), an outer tube diameter is 40 mm, a tube wall thickness is 7 mm, and wherein value pairs of the heat flow density $q_a$ and the mass flow density $\dot{m}$ lie along a curve in a cartesian coordinate system defined by the following value pairs:

$q_a$=250 kW/m$^2$, $\dot{m}$=471 kg/m$^2$s, $q_a$=300 kW/m$^2$, $\dot{m}$=670 kg/m$^2$s, $q_a$=350 kW/m$^2$, $\dot{m}$=940 kg/m$^2$s, and $q_a$=400 kW/m$^2$, $\dot{m}$=1322 kg/m$^2$s.

7. The once-through steam generator according to claim 1, wherein said tubes consist of 13 CrMo 44 (T12 of ASTM A213), an outer tube diameter is 30 mm, a tube wall thickness is 6 mm, and wherein value pairs of the heat flow density $q_a$ and the mass flow density $\dot{m}$ lie along a curve in a cartesian coordinate system defined by the following value pairs:

$q_a$=250 kW/m$^2$, $\dot{m}$=420 kg/m$^2$s, $q_a$=300 kW/m$^2$, $\dot{m}$=576 kg/m$^2$s, $q_a$=350 kW/m$^2$, $\dot{m}$=775 kg/m$^2$s, and $q_a$=400 kW/m$^2$, $\dot{m}$=1037 kg/m$^2$s.

8. The once-through steam generator according to claim 1, wherein said tubes consist of 13 CrMo 44 (T12 of ASTM A213), an outer tube diameter is 40 mm, a tube wall thickness is 6 mm, and wherein value pairs of the heat flow density $q_a$ and the mass flow density $\dot{m}$ lie along a curve in a Cartesian coordinate system defined by the following value pairs:

$q_a$=250 kW/m$^2$, $\dot{m}$=399 kg/m$^2$s, $q_a$=300 kW/m$^2$, $\dot{m}$=549 kg/m$^2$s, $q_a$=350 kW/m$^2$, $\dot{m}$=737 kg/m$^2$s, and $q_a$=300 kW/m$^2$, $\dot{m}$=977 kg/m$^2$s.

9. A method of configuring a once-through steam generator with a combustion chamber surrounded by a containment wall composed of substantially vertical tubes connected to one another in a gastight manner, wherein the tubes are adapted to conduct therethrough an upwardly flowing flow medium during an operation of the once-through steam generator, the method which comprises:

forming the tubes with a surface structure on an inner wall surface thereof, and configuring the tubes such that, under an operational load at which a critical pressure $p_{crit}$ prevails in the tubes, a mass flow density $\dot{m}$ through the tubes is defined by:

$$\dot{m} = \frac{q_i}{C(T_{\max} - T_{crit} - \Delta T_W)} \quad \text{(kg/m}^2\text{s)}$$

where $q_i$ (kW/m$^2$) is a heat flow density on an inside of the tubes, $T_{max}$ is a maximum permissible material temperature of the tubes, $T_{crit}$ is a temperature of the flow medium at the critical pressure, $\Delta T_W$ is a temperature difference between an outer wall and the inner wall of the tubes, and $C\geqq 7.3\cdot 10^{-3}$ kWs/kgK is a constant.

10. The method according to claim 9, which further comprises defining the tubes such that the heat flow density $q_i$ at the inner wall surface of the tubes conforms to the following relationship:

$$q_i = \frac{K \cdot d_a}{d_i} \cdot q_a \quad \text{(kW/m}^2\text{)}$$

with $K=A\cdot(d_a^2\cdot q_a)+B$, and
wherein:

$A=0.45$, $B=0.625$ for $(d_a^2\cdot q_a)\leqq 0.5$ kW $A=0.25$, $B=0.725$ for $(d_a^2\cdot q_a)>0.5$ and $\leqq 1.1$ kW $A=0$ and $B=1$ for $(d_a^2\cdot d_a)>1.1$ kW;

$q_a$ (kW/m$^2$) is a heat flow density at an outer surface of the tubes and $d_a$ (m) is the outer tube diameter.

11. The method according to claim 9, which further comprises defining the tubes such that the maximum admissible material temperature $T_{max}$ conforms to the relationship:

$$T_{\max} = T_{crit} + \frac{6 \cdot \sigma_{perm}}{\beta \cdot E} \quad (^\circ\text{ C.})$$

in which $\sigma_{perm}$ is a permissible thermal stress, $\beta$ is a coefficient of thermal expansion, and E is a modulus of elasticity of a tube material.

12. The method according to claim 9, which further comprises defining the tubes such that a temperature difference $\Delta T_W$ between an outer wall surface of the tubes and an inner wall surface of the tubes conforms to the relationship:

$$\Delta T_w = \left(\frac{1+K}{2}\right)\frac{q_a \cdot d_a}{2\lambda} \cdot \ln\frac{d_a}{d_i} \quad \text{(K)}$$

with $K=A\cdot(d_a^2\cdot q_a)+B$, and
wherein:

$A=0.45$, $B=0.625$ for $(d_a^2\cdot q_a)\leqq 0.5$ kW $A=0.25$, $B=0.725$ for $(d_a^2\cdot q_a)>0.5$ and $\leqq 1.1$ kW $A=0$ and $B=1$ for $(d_a^2\cdot q_a)>1.1$ kW;

$q_a$ (kW/m$^2$) being a heat flow density on the tube outside, $d_a$ (m) being the outer tube diameter, $d_i$ (m) being the inner tube diameter, and $\lambda$ (kW/mK) being the thermal conductivity of the tube material.

13. The method according to claim 9, which further comprises defining the tubes to be made from 13 CrMo 44 (T12 of ASTM A213), to have an outer tube diameter of 30 mm and a tube wall thickness of 7 mm, and defining value pairs of the heat flow density $q_a$ and the mass flow density $\dot{m}$ along a curve in a cartesian coordinate system through by the following value pairs:

$q_a$=250 kW/m$^2$, $\dot{m}$=526 kg/m$^2$s, $q_a$=300 kW/m$^2$, $\dot{m}$=750 kg/m$^2$s, $q_a$=350 kW/m$^2$, $\dot{m}$=1063 kg/m$^2$s, and $q_a$=400 kW/m$^2$, $\dot{m}$=1526 kg/m$^2$s.

14. The method according to claim 9, which further comprises defining the tubes to be made from 13 CrMo 44 (T12 of ASTM A213), to have an outer tube diameter of 40 mm and a tube wall thickness of 7 mm, and defining value pairs of the heat flow density $q_a$ and the mass flow density $\dot{m}$ along a curve in a cartesian coordinate system through by the following value pairs:

$q_a$=250 kW/m$^2$, $\dot{m}$=471 kg/m$^2$s, $q_a$=300 kW/m$^2$, $\dot{m}$=670 kg/m$^2$s, $q_a$=350 kW/m$^2$, $\dot{m}$=940 kg/m$^2$s, and $q_a$=400 kW/m$^2$, $\dot{m}$=1322 kg/m$^2$s.

15. The method according to claim 9, which further comprises defining the tubes to be made from 13 CrMo 44 (T12 of ASTM A213), to have an outer tube diameter of 30 mm and a tube wall thickness of 6 mm, and defining value pairs of the heat flow density $q_q$ and the mass flow density $\dot{m}$ along a curve in a Cartesian coordinate system through by the following value pairs:

$q_a$=250 kW/m$^2$, $\dot{m}$=420 kg/m$^2$s, $q_a$=300 kW/m$^2$, $\dot{m}$=576 kg/m$^2$s, $q_a$=350 kW/m$^2$, $\dot{m}$=775 kg/m$^2$s, and $q_a$=400 kW/m$^2$, $\dot{m}$=1037 kg/m$^2$s.

16. The method according to claim 9, which further comprises defining the tubes to be made from 13 CrMo 44 (T12 of ASTM A213), to have an outer tube diameter of 40 mm and a tube wall thickness of 6 mm, and defining value pairs of the heat flow density $q_a$ and the mass flow density $\dot{m}$ along a curve in a Cartesian coordinate system through by the following value pairs:

$q_a$=250 kW/m$^2$, $\dot{m}$=399 kg/m$^2$s, $q_a$=300 kW/m$^2$, $\dot{m}$=549 kg/m$^2$s, $q_a$=350 kW/m$^2$, $\dot{m}$=737 kg/m$^2$s, and $q_a$=400 kW/m$^2$, $\dot{m}$=977 kg/m$^2$s.

* * * * *